US006466115B1

(12) United States Patent
Baujan et al.

(10) Patent No.: US 6,466,115 B1
(45) Date of Patent: Oct. 15, 2002

(54) LOW VOLTAGE SWITCHGEAR WITH BIMETALLIC ACTUATOR

(75) Inventors: Gunter Baujan, Troisdorf; Rudolf Baumeister, Hennef; Volker Blechacz, Bornheim; Manfred Faust, St. Augustin; Klaus Dauer, Koblenz; Lothar Winzen, Unkel; Peter Willerscheidt, Remagen, all of (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/719,798

(22) PCT Filed: Apr. 5, 2000

(86) PCT No.: PCT/EP00/02997

§ 371 (c)(1),
(2), (4) Date: Feb. 9, 2001

(87) PCT Pub. No.: WO00/63935

PCT Pub. Date: Oct. 26, 2000

(30) Foreign Application Priority Data

Apr. 15, 1999 (DE) ..... 199 16 988

(51) Int. Cl.[7] ..... H01H 75/08; H01H 77/04; H01H 81/02

(52) U.S. Cl. ..... 335/6; 335/43; 335/45

(58) Field of Search ..... 335/43–45, 132

(56) References Cited

U.S. PATENT DOCUMENTS

| | | | | |
|---|---|---|---|---|
| 4,622,444 A | | 11/1986 | Kandatsu et al. | 200/303 |
| 4,698,606 A | * | 10/1987 | Mrenna et al. | 335/45 |
| 5,909,164 A | | 6/1999 | Lee | 335/202 |
| 6,104,273 A | * | 8/2000 | Larranaga et al. | 337/82 |

FOREIGN PATENT DOCUMENTS

| | | |
|---|---|---|
| DE | 4202049 | 10/1993 |
| DE | 4304772 | 5/1994 |

* cited by examiner

*Primary Examiner*—Ramon M. Barrera
(74) *Attorney, Agent, or Firm*—Horst M. Kasper

(57) ABSTRACT

The invention relates to a low voltage switchgear with a bimetallic actuator, especially to a motor safety switch. The aim of the invention is to improve such a low voltage switchgear so that the fabrication and assembly tolerances are widely compensated for. To this end, the two-part (21, 22) housing (2) of the switchgear (1) is provided with an opening (23), that is closed with a protective cover (24). By way of said opening (23), the bimetallic component (51) and the jack system are accessible for the purpose of measurement and a bridge system (52) of the bimetallic actuator (5) that is calibrated on the basis of the measured values can be mounted therethrough.

7 Claims, 2 Drawing Sheets

LOW VOLTAGE SWITCHGEAR WITH BIMETALLIC ACTUATOR

TECHNICAL FIELD

Figure 1:
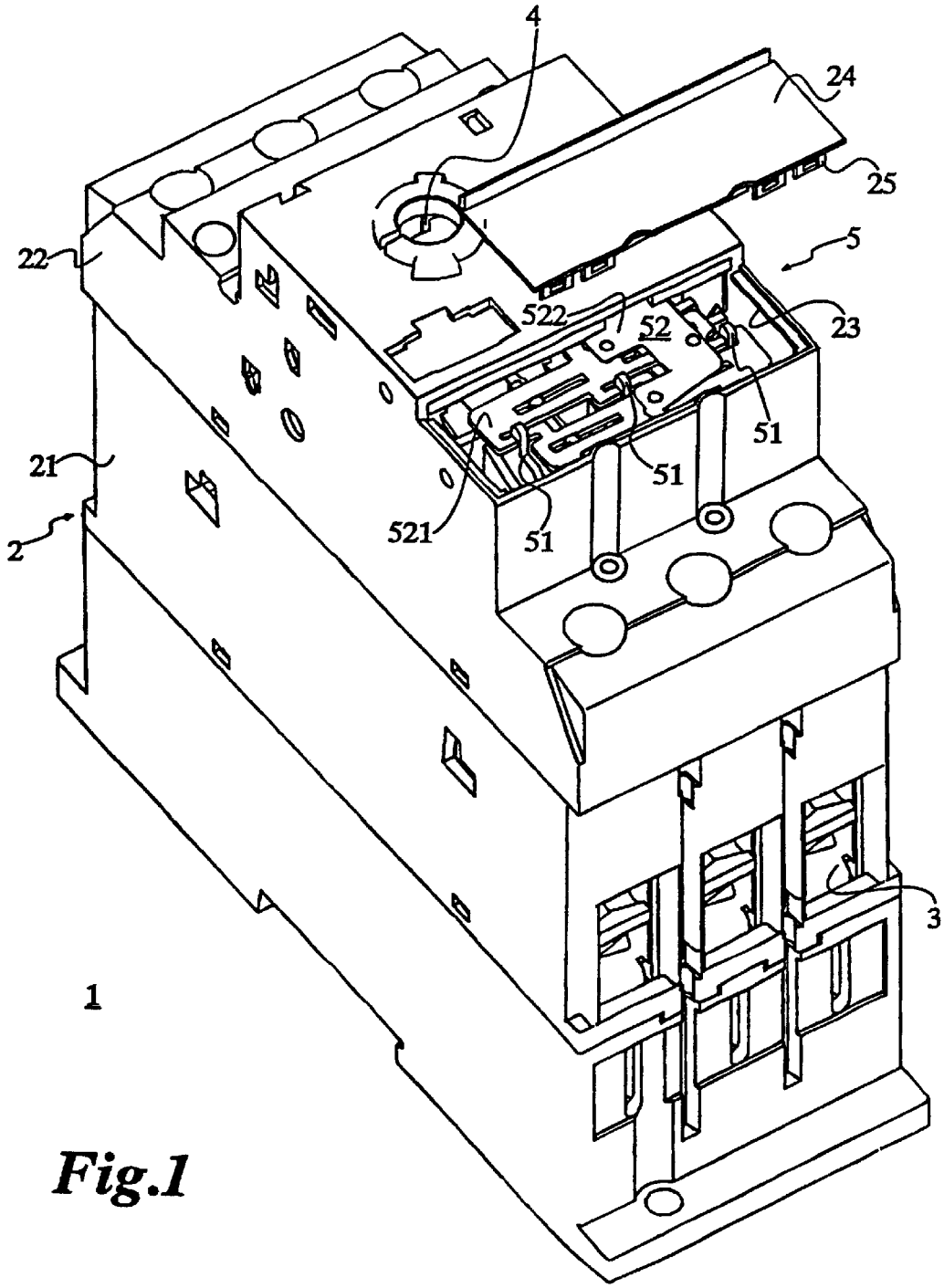

The invention relates to a low voltage switch gear with a bimetallic tripping device, in particular a motor protection switch or a power switch.

1. State of the Art

Such switch gears are to be calibrated by the manufacture with respect to the bimetallic tripping device. The tolerances present between the bimetallic strips of the individual phases are to be balanced amongst each other, are to be balanced between the bi-metals and the flip point of the releasing jack system as well as to be balanced with respect to a required empty path of the bi-metals. Such a bi-metal tripping device and a corresponding pawl or jack system are described in detail in the German printed patent document DE 4202049. The calibration process is in general performed such that after a measurement technical capturing of the release paths of the bi-metal device group and of the flip point of the jack system, a bridge system to be actuated by the bending out of the bi-metals is balanced with respect to that punchings for the engagement of the bi-metals are performed exactly in that measure corresponding to the above recited measurement technical capturing such that the above recited tolerances are balanced out as far as possible after completing of the bi-metal device group by the bridge system. This process of the balancing of the bridge system is designated in the following as calibrating by punching. By performing calibration by punching recited tolerances are in fact balanced, however, the together assembly according to U.S. Pat. No. 5.909,164 in a lower casing part of the switch gear together with the contact system and the drive system of a loosely supported bimetallic device group, of the bridge system, and of an upper casing part required for the support and covering of these parts entail the associated danger not to be underestimated, that new tolerances are generated between the bi-metal group, the bridge system and the pawl system.

2. Presentation of the Invention

Therefore it is an object of the invention to eliminate tolerances between bi-metal tripping device and jack system generated during assembly of the switch gear.

The object is accomplished according to the present invention by the characterizing features of the independent claims starting from a low voltage switch gear. It is now possible based on an opening furnished in the casing to capture the bi-metal device group and the pawl system in the finally incorporated state for the purpose of calibration of the still not incorporated bridge system by a measurement technology, then to assemble the correspondingly calibrated bridge system, and finally to close the opening by the protective cover. All tolerances concerning the bi-metal tripping device are captured advantageously over the complete production and assembly chain during calibration of the bridge system. After the calibration only one device group, namely the bridge system, is to be incorporated with the switch gear according to the present invention in contrast to switch gear of the state of the art. An advantageous further development of the invention comprises that the protective cover is lockingly attached on the casing.

SHORT DESCRIPTION OF THE DRAWINGS

Figure 2:
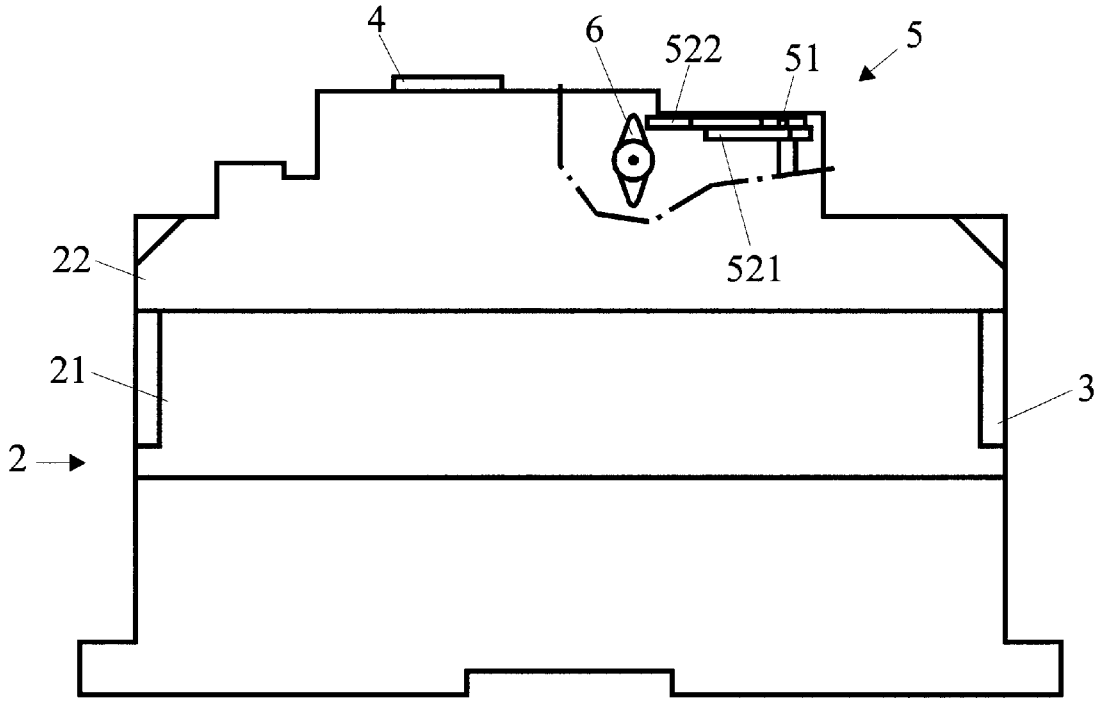

Further advantages of the invention result from the following embodiment, where there is shown in FIG. 1 a perspective and exploded view of a low voltage switch gear according to the present invention, FIG. 2 a schematic diagram of the device of FIG. 1 including a view of a jack system.

BEST PATH FOR PERFORMING THE INVENTION

A motor protective switch with the casing is made out of molding material, comprising a lower casing part 21 and an upper casing part 22, three input side connection terminal clamps 3, three oppositely disposed output side connection terminal clamps as well as an interface 4 for a turning handle or twist grip for actuating the contact system of the switch gear 1 is illustrated as switch gear 1 in FIG. 1. A rectangular opening 23 is furnished in the upper casing part 22 on the front side, wherein the rectangular opening 23 is to be closed by a protective cover 24, wherein locking means 25 are applied. The bi-metal tripping device 5 is accessible through the opening 23. The free ends of the bi-metal device group 51 as well as the bridge system 52 comprising the release bridge 521 cooperating with the bi-metal device group 51 and differential lever 522 generating the connection to a pawl system 6 of a not visible drive system are visible from the bi-metal tripping device 5. When the bridge system 52 has not yet been incorporated, the bending out of the bi-metal device group 51 and the flip point of the pawl system 6 are captured by suitable mechanical test keys through the opening 23. The corresponding recesses are punched into the triggering bridge 521 for the engagement of the free ends of the bi-metal device group 51 based on the measurement results (calibration by punching). The bridge system 52 calibrated in this manner is thereupon inserted through the opening 23 for completing of the bi-metal trigger 5 and thus for completing of the switch gear 1. Thereupon the protective cover 24 is locked onto the upper casing part 22.

The present invention is not limited to the precedingly described embodiment, but comprises also all embodiments acting in a like way in the sense of the present invention. For example, the invention can be modified in that direction that upon a corresponding requirement the opening 23 and the cover 24 are furnished at the lower casing part 21 or at the two casing parts 21, 22.

What is claimed is:

1. Low voltage switch gear with a bi-metal tripping device, comprising a casing (2) including casing parts (21, 22), wherein at least the bi-metal tripping device (5) and a jack system (6) to be triggered by the bi-metal tripping device (5) is supported in the casing (2), wherein the bi-metal tripping device (5) exhibits a removable bridge system (52) for calibration as a connection member between the bi-metal device group (51) of the bi-metal tripping device (5) and the jack system (6), characterized in that the casing (2) is finished with an opening (23) closable by a protective cover (24), wherein the opening (23) assures the accessibility of the bi-metal device group (51) and of the jack system (6) in the construction of the switch gear (1), wherein the opening (23) is sufficiently large to allow inserting the removable bridge system (52) from the outside through the opening (23) into the casing part (22) and onto the bi-metal device group (51).

2. Low voltage switch gear according to claim 1, characterized in that the protective cover (24) is connectable through locking means (25) to the remaining casing (2).

3. A low voltage switch gear including a bi-metal tripping device, comprising a casing (2);

a bi-metal tripping device (5);

a protective cover (24);

a jack system (6) connected to the bi-metal tipping device (5) and to be triggered by the bi-metal tripping device (5) and supported in the casing (2), wherein the bi-metal tipping device (5) includes a disengageable and calibratable bridge system (52) as a connection member between a bi-metal device group (51) of the bi-metal tripping device (5) and the jack system (6), wherein the bridge system can be disengaged from the bi-metal device group (51) and from the jack system (6), wherein the casing (2) is furnished with an opening (23) closable by the protective cover (24), wherein the opening is of sufficient size and positioned to allow insertion of the bridge system (52) through the opening and wherein the opening (23) assures accessibility of the bi-metal device group (51) and of the jack system (6) in the construction of the switch gear (1).

4. The low voltage switch gear according to claim 3 further comprising locking means, wherein the protective cover (24) is connectable to the remaining casing (2) with the locking means (25).

5. A low voltage switch gear comprising a casing (2) including a lower casing part (21) and an upper casing part (22);

an actuating interface (4);

a rectangular opening (23) finished in the upper casing part (22);

a protective cover (24) closing the rectangular opening (23);

locking means (25) for locking the protective cover (24) onto the upper casing part (22);

a bi-metal tripping device 5 accessible through the rectangular opening (23);

a bi-metal device group (51) activating the bi-metal tripping device 5 when an overcurrent occurs;

a bridge system (52) for calibration by punching including a release bridge (521) cooperating with the bi-metal device group (51) and a differential lever (522) connected to the release bridge (521); wherein the rectangular opening (23) assures the measurement technology accessibility of the bridge system (52); and wherein the bridge system (52) supplies corresponding tolerances for an engagement of the bi-metal device group (51).

6. A low voltage switch gear including a bi-metal tripping device, comprising a casing (2);

a bi-metal tripping device (5);

a protective cover (24);

a jack system (6) connected to the bi-metal tripping device (5) and to be triggered by the bi-metal tripping device (5) and supported in the casing (2), wherein the bi-metal tripping device (5) includes a separatable and transportable bridge module (52) as a connection member between a bi-metal device group (51) of the bi-metal tripping device (5) and the jack system (6), wherein the bridge module can be disengaged from the bi-metal device group (51) and from the jack system (6), wherein the casing (2) is fished with an opening (23) closable by the protective cover (24), wherein the opening is of sufficient size and positioned to allow insertion of the bridge module (52) through the opening and wherein the opening (23) assures accessibility of the bi-metal device group (51) and of the jack system (6) in the construction of a switch gear (1).

7. A method for calibrating a switch gear including a casing (2) including a lower casing part (21) and an upper casing part (22);

a rectangular opening (23) furnished in the upper casing part (22); a protective cover (24) to close the rectangular opening (23); locking means (25) for locking the protective cover (24) onto the upper casing part (22); a bi-metal tripping device 5 accessible through the rectangular opening (23); a bi-metal device group (51) activating the bi-metal tripping device 5 when the overcurrent occurs; a bridge module (52) suitable for calibration by punching including a release bridge (521) cooperating with the bi-metal device group (51) and a differential lever (522) connected to the release bridge (521); wherein the rectangular opening (23) assures the measurement technological accessibility of the bridge module (52); wherein the bridge module (52) supplies a corresponding tolerances for an engagement of the bi-metal device group (51) comprising the steps:

unlocking the protective cover (24);

opening the rectangular opening (23);

measuring tolerances between the bi-metal device group (51) and the bridge module (52);

capturing the bridge module (52);

performing the calibration of the bridge module (52) by punching;

assembling the correspondingly calibrated bridge module (52) with the bi-metal device group (51) through the rectangular opening (23);

closing the rectangular opening (23) by the protective cover (24);

locking the protective cover (24) onto the upper casing part (22) by means the locking means (25).

* * * * *